US006029927A

United States Patent [19]

Wohlfahrt et al.

[11] Patent Number: 6,029,927

[45] Date of Patent: Feb. 29, 2000

[54] REELING MACHINE AND A PROCESS TO REEL A WEB

[75] Inventors: Matthias Wohlfahrt, Ulm; Thomas Martin, Langenau; Zygmunt Madrzak; Roland Thomas, both of Heidenheim, all of Germany

[73] Assignee: Voith Sulzer Papiermaschinen GmbH, Hendenheim, Germany

[21] Appl. No.: 09/041,967

[22] Filed: Mar. 13, 1998

[30] Foreign Application Priority Data

Mar. 13, 1997 [DE] Germany ..... 197 10 282

[51] Int. Cl.[7] ..... B65H 35/04

[52] U.S. Cl. ..... 242/527.2; 242/527.5; 242/532.2; 242/532.3; 242/542.3

[58] Field of Search ..... 242/527.2, 527.3, 242/527.4, 527.5, 527.6, 527.7, 526.3, 521, 532.2, 532.3, 532.7, 542.3

[56] References Cited

U.S. PATENT DOCUMENTS

| | | | |
|---|---|---|---|
| 2,176,198 | 10/1939 | Berry | 242/542.3 |
| 2,361,795 | 10/1944 | Roesen | 242/542.3 |
| 2,528,713 | 11/1950 | Thomson | 242/542.3 |
| 2,579,199 | 12/1951 | Marcalus | 242/542.3 |
| 3,258,217 | 6/1966 | MacArthur | 242/542.3 |
| 3,494,566 | 2/1970 | Pawelczyk | 242/542.3 |
| 3,610,545 | 10/1971 | Reifenhauser | 242/542.3 |
| 3,721,396 | 3/1973 | Morizzo | 242/542.3 |
| 3,794,255 | 2/1974 | Harmon et al. | 242/542.3 |
| 4,146,187 | 3/1979 | Steiner et al. | 242/521 |
| 4,515,321 | 5/1985 | Kahlman | 242/527.3 |
| 4,546,930 | 10/1985 | Rohde et al. | 242/521 |
| 4,695,004 | 9/1987 | Grossmann et al. | 242/526.3 |
| 4,778,122 | 10/1988 | Saygg | 242/533.1 |
| 5,360,179 | 11/1994 | Vesterinen et al. | 242/532.2 |
| 5,531,396 | 7/1996 | Kinnunen et al. | 242/526.3 |
| 5,611,500 | 3/1997 | Smith | 242/542.3 |
| 5,690,298 | 11/1997 | Ruck | 242/542.3 |
| 5,782,426 | 7/1998 | Kinnunen et al. | 242/532.3 |

FOREIGN PATENT DOCUMENTS

| | | |
|---|---|---|
| 0089595 | 9/1983 | European Pat. Off. . |
| 2423021 | 4/1975 | Germany . |
| 2655956 | 6/1978 | Germany . |
| 2705776 | 8/1978 | Germany . |
| 2721883 | 11/1978 | Germany . |
| 2844519 | 4/1979 | Germany . |
| 3321213 | 12/1984 | Germany . |
| 3515519 | 10/1986 | Germany . |
| 4401804 | 6/1994 | Germany . |
| 2009108 | 6/1979 | United Kingdom . |

*Primary Examiner*—John M. Jillions
*Attorney, Agent, or Firm*—Greenblum & Bernstein, P.L.C.

[57] ABSTRACT

A reeling machine for winding a web, in particular a paper or cardboard web, for the formation of a wound web roll on a reel-spool, with a reeling drum, which forms a winding nip with the wound web roll and with at least one separating mechanism, which separates the web in a separating area. In the reeling machine, the separating mechanism is advanced before the separating process—as seen in vertical direction—from above to the separating area, which lies at a short distance to the outer periphery of the new reel-spool and/or—as seen in run direction of the web—to the winding nip between the reeling drum and the new reel-spool.

26 Claims, 8 Drawing Sheets

REELING MACHINE AND A PROCESS TO REEL A WEB

CROSS-REFERENCE TO RELATED APPLICATIONS

The present application claims priority under 35 U.S.C. § 119 of German Patent Application No. 197 10 282.4, filed on Mar. 13, 1997, the disclosure of which is expressly incorporated by reference herein in its entirety.

BACKGROUND OF THE INVENTION

1. Field of the Invention

The invention relates to a reeling machine to reel a web, in particular a paper or cardboard web and a process to reel a web, in particular a paper or cardboard web.

2. Discussion of Background Information

Reeling machines and processes are known (U.S. Pat. No. 5,360,179), which reel a continuous web on a reel-spool to a wound web roll. A known reeling machine comprises a reeling drum or pope (bearing) reel, which, together with the wound web roll or winding drum, forms a winding nip that the web passes through. In the event of a reel-spool change—during the reeling of the web onto the wound web roll —an empty reel-spool is laid or pressed on the periphery of the reeling drum, over which the web is guided. Furthermore, the full wound web roll is moved and thereby lifted by the reeling drum during the formation of an intermediary space. The wound web roll is then retarded so that a web loop is formed in the intermediate space between the reeling drum and the wound web roll, in which the web is guided in a free stretch. The web loop is put around the empty reel-spool and is guided into the reel nip formed between the empty reel-spool and the reeling drum. Thereafter, the portion of the web loop guided to the finished wound web roll pulls away with an undefined break and is reeled onto the wound web roll that is phasing-out. In the known reeling machine and in the known process, it is especially disadvantageous that the web is separated in an undefined tearing process, through which long web shreds are often formed, which, after the changing of the reel-spool, must be cut from the finished wound web roll. Furthermore, the reel layers must be rolled off of the finished wound web roll, which were reeled in a free stretch condition during the guiding of the web, since these reel layers are relatively loose and do not demonstrate the desired reel hardness. A loud sound or report, which is determined by the weight and firmness of the web, occurs as a result of the unclean tearing of the web, leading to a jarring of the reeling mechanism. Moreover, a desired core reeling is not possible through the web loop that is torn away and wrapped up on the empty reel-spool, whereby the further reeling process is often impeded by a pulling motion of the reeler. Furthermore, it has been observed that due to the high acceleration of the web after having been pulled into the nip—that is, in the reeling nip between the reeling drum and the empty reel—, spool, it is possible that the remaining stretch of the web again tears in an undefined manner and web shreds form. Depending on the motion of the shreds, these shreds are then either reeled into the wound web roll that is reeled onto the new reel-spool, or they must be blown away manually with air blast tubes.

A reeling machine and a process for reeling a web on a reel-spool to a wound web roll are known from DE 44 01 804 A1, wherein a separation device is installed, which is steered from below into the region of the free web stretch between the new reel-spool, over the periphery of which the web is guided to the most complete wound web roll and a separation device separates the web in this area. The disadvantage in using a separation device that is advanced from below to the free web stretch is that in many cases the new web front end does not lie smoothly on the outer periphery of the new reel-spool after the separation of the web, rather, it is pulled along as a downward hanging, relatively long flap by the reel-spool jacket and is guided into the nip between the new reel-spool and the reeling drum. As a rule, this proceeds unevenly over the web width, in particular with a high running speed of the web, which can amount to up to 2,500 m/min and more. Furthermore, it has been demonstrated that the web, despite the use of the separation device, often rips at several points, through which shreds are formed, which are reeled in the wound web roll in an undefined manner and which interfere with the designed composition of the wound web roll.

SUMMARY OF THE INVENTION

The task of the invention is thus to create a reeling machine and a process that does not demonstrate the foregoing disadvantages.

The reeling machine is distinguished in that before the separation process, the separation device is advanced—as viewed in vertical direction—from above to the separation region, which lies at a small distance from the outer periphery, that is, from the jacket of the new reel-spool and/or—as seen in the run direction of the web—from the reel nip between the reeling drum and the new reel-spool. Thus, the flap of the new beginning web, which is formed in the separation of the web and hanging downward that is, the loose end of the material web which is reeled onto the empty reel-spool—is significantly shorter than the kind which occurs with the known reeling machine. A disturbance caused by noise, as well as a shaking of the machine and thus also vibrations, can be avoided through the defined separation of the web. Furthermore, it is especially advantageous that undefined tears in the web, also known as shred formation, are essentially avoided by separating the web in the immediate proximity of the outer periphery of the empty reel-spool of the nip between the reeling drum and the empty reel-spool. The formation of fluffing caused in the separation process is thus relatively low. The reeling machine is characteristically clean. Furthermore, it is to be kept in mind that the web refuse created during a reel-spool exchange is reduced in comparison to the known reeling machines, in particular, because the loose end of the web, that is, the web front-end, demonstrates a clean separating edge. A subsequent treatment of the full wound web roll, that is the rolling-off and cutting-off of the end of the web is not required. Furthermore, the web front-end that is guided over to the empty reel-spool can be reeled with a defined hardness from the beginning, which, on the one hand, improves the quality of the reeled wound web roll, and on the other hand, can guarantee an uncomplicated reeling process.

An embodiment of the reeling machine is preferred in which the separation device—as seen in run direction of the web—is disposed subsequent to a guide device, which serves to guide the loose end of the web into the reel nip between the new reel-spool and the reeling drum. The separation device hinders a detachment of the part of the web that is not adjacent to the reel-spool from the outer periphery of the empty reel-spool and the interrelated strong retardation of the web as a result of the air resistance, which would lead to a formation of shreds and to an undefined reeling of these shreds in the wound web roll reeled onto the new reel-spool. The guide device also hinders or retards or a tearing of the loose end of the web, in that it guides the web or the part of the web not lying adjacent to the outer periphery of the empty reel-spool at a marginal distance to the outer periphery of the empty reel-spool toward the reel nip (or opening) and thus avoids a strong braking of the web.

In an advantageous embodiment of the reeling machine, the guide device is formed by at least one guiding plate that extends across the entire width of the web or by at least one blowpipe, which applies a flow of a medium—for example, air or vapor—to the web or the new web front-end. In a further variation of the embodiment, the guide device comprises a textile curtain and/or a synthetic sheeting, which extend(s) transversely across the width of the web.

An embodiment of the reeling machine is also preferred which is characterized in that a blow device and/or at least one jet is provided that can impart upon the surface of the empty reel-spool a fluid or gaseous medium in order to guide the loose end of the web onto an empty reel-spool. The blow device, which is disposed near the intermediate space between the reeling drum and the wound web roll, imparts upon the web guided over a peripheral region of the empty reel-spool a flow of medium, preferably with a gaseous medium in such a manner that the deposition of the loose web end on the empty reel-spool is supported during a separation of the web. Alternatively or as an addition to the blow device, a medium that increases the adhesion of the web section that is guided over a peripheral region of the empty reel-spool can be deposited on the outer surface of the empty reel-spool, for example, wet steam, through which the deposition of the loose end of the web onto the empty reel-spool is assisted. Since the loose end of the web is reeled onto the empty reel-spool in a defined manner, a targeted core reeling can be executed, which allows, on the whole, a reeling procedure without complications and a good winding result.

An embodiment of the reeling machine that is also preferred demonstrates a separation device exhibiting at least one web separation element, which is formed by a water jet device, a doctor, a needle, a laser device or a roll on an outer toothed periphery. A particularly clean cutting edge can be created with a web separation element constructed in this manner.

Another embodiment of the reeling machine that is also preferred is characterized in that the separation device can be moved along a beam that extends at least essentially transversely across the width of the web. The web—beginning with one of the two web edges—is separated along the beam to the other web edge by the procedure of the separation device, which allows for the formation of a particularly even separation edge.

An embodiment of the reeling machine that is also preferred is characterized in that the separation device comprises at least two web separation elements, which essentially can be moved in opposing directions. The separation process can begin near the center of the web; the web separation elements are thus respectively moved in the direction of a web edge. It is also possible that the web separation elements are respectively disposed on an edge of the web and are moved toward each other to separate the web, that is, toward the middle of the web.

The process to reel a web, in particular, paper or cardboard web, forming a wound web roll on a reel-spool, proceeds with the following steps: in order to prepare a change of a reel-spool, an empty reel-spool is inserted from above into a separation area and a reel nip is formed between the new, empty reel-spool and the reeling drum by a relative movement between the reel-spool and the reeling drum. Thereafter, the web lying over a peripheral region adjacent the outer periphery of the new reel-spool is separated at a short distance to the new reel-spool, that is, to its outer periphery and/or—as seen in the run direction of the web—to the reel nip between the reeling drum and the new reel-spool. Because the part of the loose end of the web (web front-end) not adjacent the outer periphery of the empty reel-spool is preferably very short, formation of shred can be avoided and a good reeling result can be attained. The defined separation of the web results in a very marginal fluffing and, thus, the cleanliness of the reeling machine can be improved.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The reeling machine described below generally can be used for reeling a web—for example, paper, cardboard, plastic, or textile web—onto a reel-spool to a wound web roll. The reeling machine can be disposed at the end of a machine for manufacturing or upgrading of the web, in order to reel the finished web to a wound web roll. The reeling machine can also be used to re-roll an already completely reeled winding drum, also characterized as a wound web roll.

Figure 1:
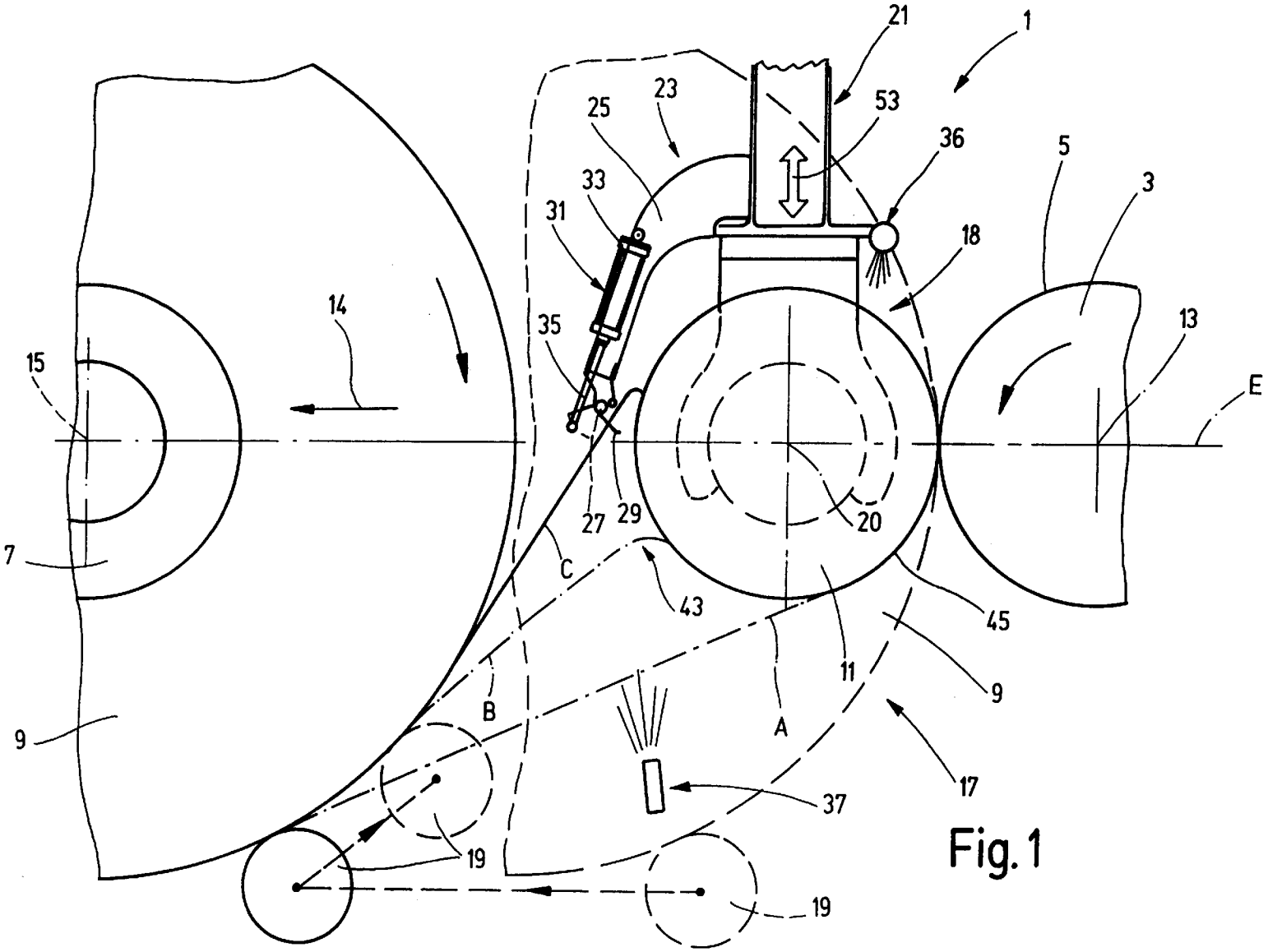
FIG. 1 illustrates a section of the first embodiment of the reeling machine in accordance with the invention, in side-view.

FIG. 1 shows a section of an embodiment of the reeling machine 1 in schematic depiction. Reeling machine 1 comprises a pope (bearing) reel 3—also characterized as a support drum, a reeling drum, or pressing roll—around which a web 5 is guided. By means of an actuation that is not depicted, the reeling drum (pope reel) 3 can be imparted or provided with a defined torque, preferably center-actuation. The web 5 is reeled on a reel-spool—also characterized as a winding tube or winding core—to a wound web roll (winding drum) 9. During the reeling of the web 5, the reeling drum 3 forms a reel nip with the wound web roll 9, which is depicted with a dashed line; a defined line pressure is present in the reel nip. The line pressure in the reel nip is adjusted through the pressing of the reeling drum 3 on the wound web roll 9 and/or by pressing the wound web roll 9 against the reeling drum 3. The adjustment of the line pressure in the reel nip allows the reel layers of the reel drum 9 to be reeled with a desired reel hardness. Purely as an example, it is assumed below that the actuated reeling drum 3 is in a stationary position and the wound web roll 9 can be displaced relative to the opposing reeling drum 3. In conjunction with the present invention, one understands the positioning term "stationary", as a position that allows a rotary movement of the reeling drum 3 on its longitudinal axis 13 and prevents a translational movement.

To divert (or deviate) the continuously fed web 5 to an empty reel-spool 11, i.e., to carry out or perform a so-called turn-up, the wound web roll 9 is moved along an imaginary plane E, depicted in FIG. 1 with a dashed line, to the left in the direction of an arrow 14, through which the distance between the longitudinal axis 13 of the reeling drum 3 and the longitudinal axis 15 of the wound web roll 9—both of which are located in plane E—increases and an intermediate space 17 is formed between reeling drum 3 and wound web roll 9. The wound web roll 9 thereby assumes the position illustrated in FIG. 1 by a solid line. In the region of the intermediate space 17, the web 5 is transferred in a free stretch from the reeling drum 3 to the wound web roll 9. The imaginary plane E is disposed horizontally, or at least substantially horizontally. The reel-spools are supported by beams (not depicted), at least during the reeling procedure.

To guarantee that all reel layers of the wound web roll 9 are reeled with a desired reel hardness, an auxiliary roll 19, which is also characterized as a wringer roll, is planned; this can be pressed against the periphery of the wound web roll 9 with a pre-determined pressure. Before the wound web roll 9 is displaced to form the intermediate space 17, the auxiliary roll 19 is pressed against the periphery of the wound web roll 9, as is shown with dashes in FIG. 1. The auxiliary roll 19 and the wound web roll 9, therefore, form a reel nip. In the event of a displacement of wound web roll 9, the auxiliary roll 19 that is moveable by means of a device (not depicted), is guided subsequent to the wound web roll 9 in such a manner that the line pressure in the reel nip between the auxiliary roll 19 and the wound web roll 9 retains the desired predetermined pressure value.

With the aid of a transfer device 18, the empty reel-spool is brought from above—preferably pre-accelerated to rotate at the running speed of the web 5—into the intermediate space 17 between the reeling drum 3 and the wound web roll 9; the reel-spool is held on the transfer device 18 in a manner, such that it can rotate. The empty reel-spool 11 is guided in the web 5 that is guided in a free stretch, such that the web 5 is deflected. The web 5 adjacent to a region of the outer periphery of the reel-spool 11 is now—as is depicted with dot-dash line A—guided from the reel-spool 11 to the wound web roll 9. The longitudinal axes 20 of the reel-spool 11 lie in plane E. The reel-spool 11, which is usually borne by beams of the reeling machine, is pressed with a pre-determined force against the reeling drum 3 and forms a reel nip with it.

In this embodiment, the transfer device 18 comprises a beam 21, which extends transversely over the width of the web 5, that is, vertically in the focal plane of FIG. 1. Disposed on the beam 21 is a separation device 23, which comprises a foundation or support 25, on which a web separation element 29 that can swivel is mounted on an axis 27. A control device 31 disposed on the foundation 25 of the separation device 23 is assigned to the web separation element 29; the control device 31 is designed as a piston/cylinder unit and comprises a cylinder 33 and piston rod 35 which is guided into the cylinder. The web separation element 29 that is connected to the piston rod 35 is in the shape of a hook-shaped cross-section and extends over the entire width of the web 5. The function of the separation device 23 will be described in more detail below. Furthermore, a blow pipe 36 is disposed on the transfer device 18; here, the blow pipe 36 is affixed to the beam 21. The blow pipe 36 directs a jet (not depicted) of fluid or gas, for example, wet stream, onto the surface of the empty reel-spool 11, in particular periphery. The medium sprayed from the jet of the blow pipe 36 can be deposited on the exterior surface, that is, the periphery of the reel-spool 1 1, before the insertion of the empty reel-spool 11 in the free stretch of the web 5, or immediately after the separation of the web 5. Because of the medium, the adhesion of the web 5 guided over an outer peripheral region of the empty reel-spool 11 is increased to such an extent, that during a separation of the web 5, the part of the web 5 adjacent to the reel-spool 11 is not detached.

Reeling machine 1 also comprises a blow device 37—only depicted as a pipe-shaped element—, which is disposed below plane E in the region of the intermediate space 17 which directs a gaseous medium, for example, air, on the web 5 guided in a free stretch.

The separation and the transfer of the web 5 to the empty reel-spool 11 are described below with the assistance of an exchange of a reel-spool. Once the reel-spool 11 is advanced from a holding position assisted by the transfer device 18 into the position depicted in FIG. 1, the wound web roll 9 is braked by a braking device (not depicted), for example a center mechanism, through which a web loop 43 is formed. The formation of the web loop 43 is assisted by the blow device 37, which directs a fluid medium toward the web 5 in a vertical direction from below by a medium jet directed upward. The web loop 43 continuously builds in size on the outer periphery 45 of the reel-spool 11, while the web 5 continues to be reeled onto the wound web roll 9. Web 5, with the web loop 43 that was already formed, is depicted in FIG. 1 with a dashed-line B. To avoid or reduce an uncontrolled fluttering of the web 5 which is no longer tightly guided, the auxiliary roll 19—as is depicted with a dashed-line—is displaced counter-clockwise along the periphery of the wound web roll 9, whereby the free stretch between the reel-spool 11 and the wound web roll 9 is decreased.

Solid-line C depicts web 5 in the position, in which the web 5 is separated by the separating device 23 that is inserted from above the web. With the activation of the control device 31, the piston rod 35 extends from the cylinder 33, through which the web separating element 29 is swivelled counter-clockwise on the axis 27. The web separating element 29 thereby separates the web 5 in the area of the web loop 43 over the entire width, through which a straight separation edge forms. The separated end of the web 5 is reeled onto the wound web roll 9, while the loose end—that forms the web front end—of the web, which has already been guided over a relatively large peripheral area of the reel-spool 11, lies adjacent to reel-spool 11. The deposition of the web 5 is thereby assisted by the blow device 37. The transfer device 18 with beam 21 and the devices disposed on it, the blow device 37, and the auxiliary roll 19 can now be displaced to a neutral position, since they are not required for the further reeling process. In addition, as is shown with a double arrow 53, the transfer device 18 that can be displaced vertically is displaced, for example, vertically upward in a holding position, in which it does not hinder the proceeding reeling process and, if necessary, in which a new, empty reel-spool can be taken on.

The separating area, in which the web 5 is separated transversely over the entire width in the separation device 23 by means of the web separating element 29, is provided—as can be ascertained from FIG. 1—in the immediate proximity of the periphery of the new reel-spool 11. Thus in this advantageous manner the loose end of the web, which forms the web front end and is formed after the separation procedure, is not adjacent to the periphery of the empty reel-spool 11 and is only very short. As a result, shred formation, that is, an uncontrolled tearing of the web is hindered or retarded, even at a high running speed of the web.

By separating the web 5 in a controlled separation process and at a small distance to the outer periphery of the reel-spool 11, as well as transfer of the web to the empty reel-spool described above, impairments or problems of the reeling procedure can be avoided. A precise core reeling of the web 5 on the reel-spool 11 is possible, which allows for an improved winding effect. The auxiliary roll 19 ensures that the reel layers reeled onto the wound web roll 9 during an exchange of reel-spools demonstrate a desired reeling hardness, so that a retouching of the finished wound web roll 9, that is, the unwinding and cutting-off of these reel layers is not necessary.

Figure 2:
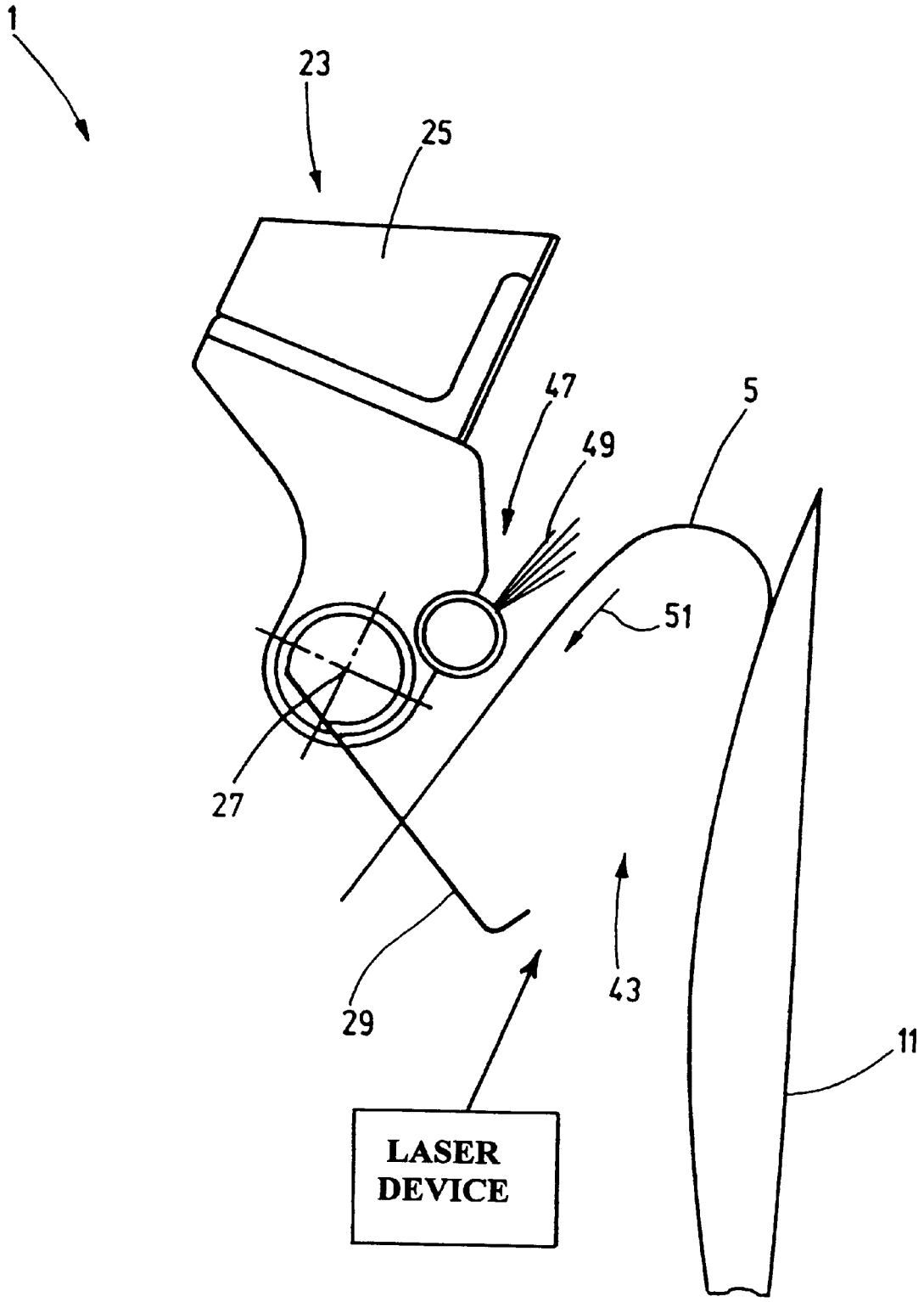
FIG. 2 illustrates a section of the reeling machine in accordance with FIG. 1, magnified to a great extent.

FIG. 2 shows a section of the reeling machine 1 enlarged to a great extent, namely the separating device 23 in the region of the web loop 43. The web separation element 29 swivelled from the control device 31—not depicted in FIG. 2—on the axis 27 is depicted in its swivelled position in the direction of the web, in which the web 5 is cut off, that is, separated. It can be ascertained from the illustration that the distance between the web separating element 29 and the outer periphery of the reel-spool 11 is marginal, so that, after the separation of the web, the flap not adjacent to the periphery of the reel-spool 11 is very short. In another embodiment, the web separation element 29 is designed to rotate on an axis. It is also possible that the web separating element can be rotated on an axis and can be displaced in the direction of the web by turning on another axis. In another embodiment of the invention, the web separation element is designed to be held stationary on the separating device 23 and the separating device 23 is able to be displaced in the direction of the web. With the help of FIGS. 3 through 11, numerous embodiments of the separation device with different methods of operation are described in more detail below.

As can be ascertained from FIG. 2, a blow pipe 47 is mounted on the foundation or support 25 of the separation device 23; the blow pipe 47 imparts to the web 5 in the area of the web loop 43 a jet of a fluid medium 49, for example, a jet of air, substantially against the web run direction that is depicted with an arrow 51. The flow of medium 49 only assists the deposition of the loose end of the web 5 onto the reel-spool, since, as a result of the separation of the web 5 in the area of the web loop 43, the loose end of the web 5, on account of its web characteristics, more or less springs back clockwise anyway and lies flat against the reel-spool 11.

To support the disposition of the separated web 5 onto the empty reel-spool, the blow device 37, the blow pipe 36, and the blow pipe 47 disposed directly at the point of separation or at the separation area can be provided. The device 37 and pipes 36, 47 can be controlled jointly and/or individually. It is also possible that—for example, with light webs or at a relatively low reeling speeds—only one or two of these devices are necessary, in order to sufficiently support the deposition of the loose end of the web 5.

It is planned in an advantageous embodiment of the reeling machine 1, that the separation device 23 is activated by a sensor mechanism, which detects the position of the web loop 43 formed by the retarding of the wound web roll 9. The sensor mechanism can, for example, also comprise an element that is responsive to light, that is, a photo diode, or similar sensor.

Figure 3A:
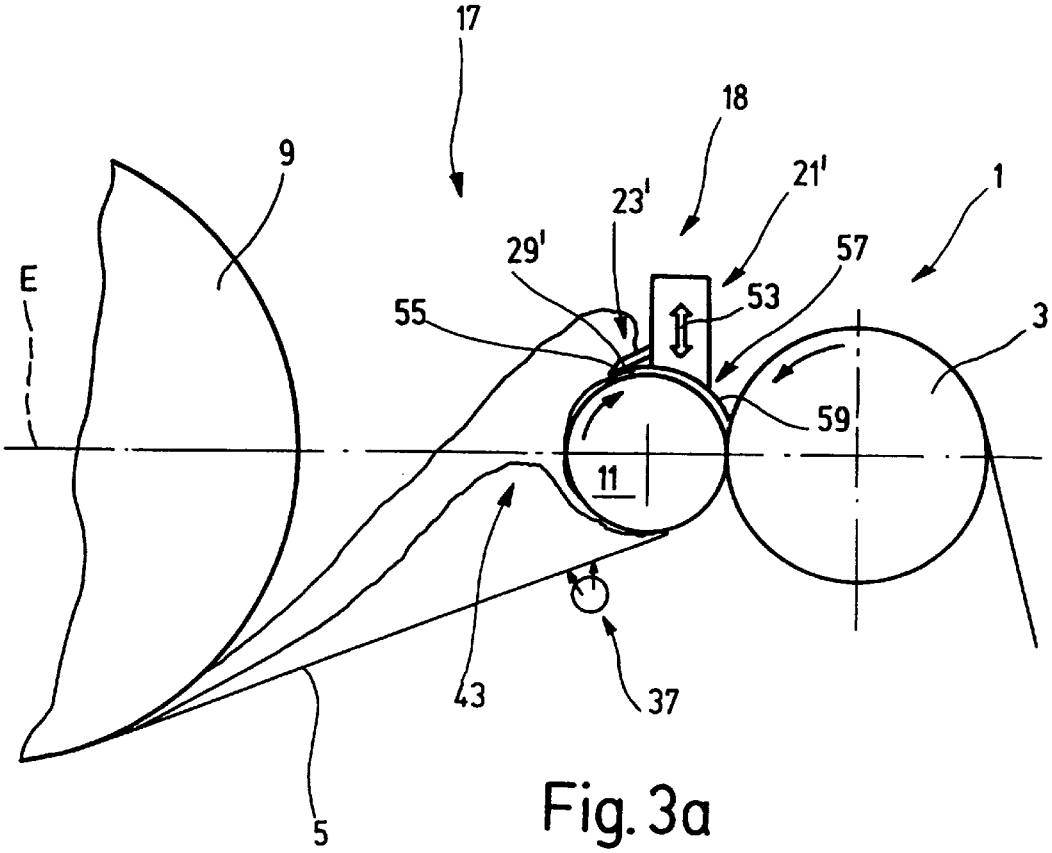
FIGS. 3*a* and 3*b* each show a third embodiment of the reeling machine, in side-view.

In a very schematic manner, FIG. 3*a* shows a portion of a further embodiment of the reeling machine 1, in side-view. Corresponding parts are designated with corresponding numbers; to this extent, one may refer to FIG. 1. In the following, only the differences will be discussed in more detail. Reeling machine 1 comprises a beam 21' that can be displaced vertically in the direction of a double arrow 53; a separation device 23' for the web 5 is mounted on the beam 21'. The separation device 23' comprises a web separation element 29' that extends transversely over the width of the web 5; the web separation element 29' is formed by a doctor 55. The doctor 55 cannot be moved opposite the beam 21', that is, it has a fixed position. Furthermore, a guide device 57 is mounted on the beam 21'; in this embodiment, the guide device 57 is formed by a guiding plate 59. The guiding plate 59, which has a curved progression, is of a shape that, for the most part, is adapted to the outer contour of the reel-spool 11 and extends, as does the doctor 55, transversely over the width of the web 5. The guiding plate 59—as seen in the running direction of the web—is disposed immediately following the separating device 23' and extends all the way to the closing nip between the reel-spool 11 and the reeling drum 3.

During a change of a reel-spool, the wound web roll that is almost complete is retarded, whereby a web loop 43 extending upward in a vertical direction is formed in the intermediate space. This web loop 43 continuously expands in size on the periphery of the reel-spool 11 and, in doing so, reaches the doctor 55 of the separation device 23' that is disposed in a fixed position. In doing so, the web 5 is separated and its loose end is guided into the nip between the cutting edge of the doctor 55 and the reel-spool 11. A detaching of the loose end of the web from the outer periphery of the reel-spool 11 is prevented by the guide device 57 disposed subsequent to the doctor 55; the guide device 57 guides the loose end of the web safely and evenly across the width in the closing nip between the reel-spool 11 and the reeling drum 3. Even with the variation of the embodiment of the separation unit described in FIG. 3*a*, the web can be separated in a clean cut transversely across the width, without formation of shreds resulting.

Figure 3B:
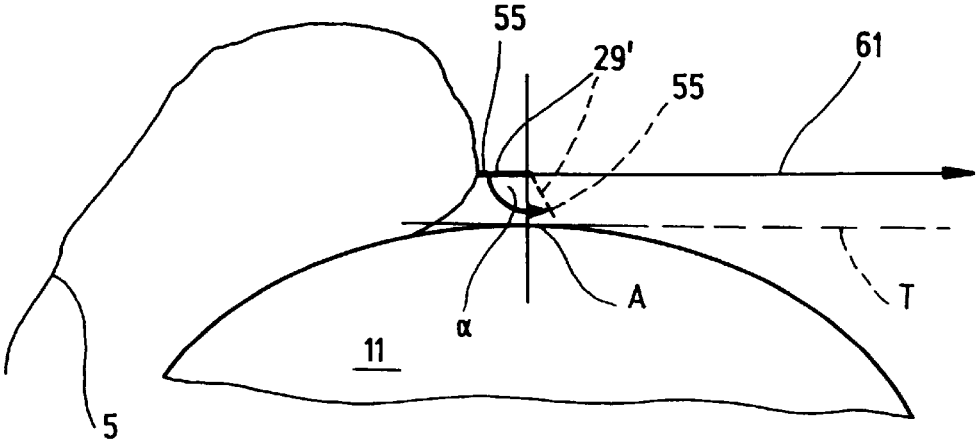

One special feature depicted in the embodiment shown in FIGS. 3*a* and 3*b* as opposed to FIG. 1 is that the doctor 55 or the cutting edge exhibits a desired, short distance to the outer periphery of the empty reel-spool, which is rotatably maintained on the transfer device 18. Thus, in the area of the web loop, which is formed by the retarding of wound web roll 9, the web can be separated with a clean, even cut, without the doctor 55 having to be moved in the direction of the web. During the intake of the web loop into the nip, the web is separated between the doctor 55 and the reel-spool 11, virtually by shearing off.

The width of the nip between the cutting edge of the doctor 55 and the empty reel-spool 11 lies in the range between approximately 2 mm to 100 mm in an embodiment of the reeling machine 1. With another embodiment, the nip width lies in a range between 5 mm and 20 mm. The nip width can generally be varied, such as in relation to the width of the reeling machine and/or the web characteristics. Therefore, width nips over approximately 100 mm are also feasible, whereby shredding can be avoided.

FIG. 3*b* shows a part of the FIG. 3*a* of the depicted reeling machine 1 in greatly magnified proportion, namely the web separating element 29', which is formed by a doctor 55. The running direction of the web 5, with reference to a point A on the outer periphery of the reel-spool 11, is shown by an arrow 61, which runs parallel to a conceptualized, tangent T—marked by a dashed line—which is applied to the reel-spool 11 at the point A in FIG. 3*b*. It is obvious that the doctor 55, which is depicted with a solid line, is directed toward the running direction (arrow 61) of the web 5. In another embodiment, it is planned that the doctor 55 is inclined facing the running direction (arrow 61) of the web 5 counter-clockwise at an angle $\alpha$ of up to approximately 120°. The doctor 55 is illustrated with a dashed line in FIG. 3*b*. The angle is approximately $\alpha=0°$ in the position of the doctor 55 which is illustrated by a solid line. The doctor 55 can be inclined practically arbitrarily in a vicinity of approximately $0° \leqq \alpha \leqq 120°$ facing the run direction of the web. The distance between the cutting edge of the doctor 55 and the reel-spool 11 becomes smaller and smaller up to an angle of approximately $\alpha=90°$ with an inclining of the doctor 55 and increases again at an angle of approximately $\alpha>90°$. Thus, an adjustment of the width nip in relation to the angle of inclination of the doctor 55 is possible in an advantageous manner facing the run direction of the web. The nip between the cutting edge of the doctor 55 and the outer periphery of the reel-spool is preferably very narrow.

In a preferred embodiment of the reeling machine, which is described using FIGS. 3*a* and 3*b*, the guiding mechanism 57 subsequent to the separating device 23' in the running direction of the web is formed by at least one blowpipe 36, which is described using FIG. 1. This can, for example, provide an air jet extending transversely across the width of the web. The orientation of the blowpipe facing the running direction of the web and/or of the empty reel-spool can be planned as with a doctor. In this embodiment of the separating device, the nip width is measured, for example, between the jet orifice of the blowpipe and the outer periphery of the empty reel-spool.

Figure 4:
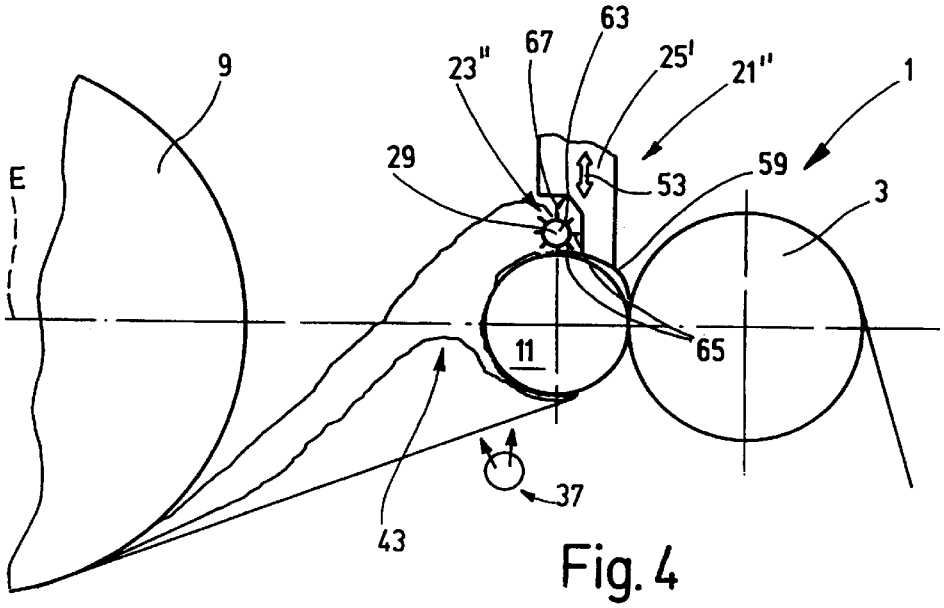
FIG. 4 illustrates a part of a third embodiment of the reeling machine, in side-view.

FIG. 4 shows a part of a third embodiment of the reeling machine 1 very schematically, which is distinguished from the one described using FIG. 3*a* only because a separating device 23" is used during the exchange of a reel-spool for the separation of the web 5; the device 23" comprises a web separating element 29" in the form of a roll 63. The roll 63 has a number of teeth 65 on its outer periphery; the teeth 65, as can be seen from FIGS. 6*a* an 6*b*, are distributed over the periphery. The roll 63 is kept rotational inside the open-ended recess 67 of the foundation 25' of the beam 21", which partially encircles the roll. The roll 63, which can be propelled or driven with the assistance of a drive mechanism not depicted here, preferably in clockwise and counter-clockwise directions, is arranged above the reel-spool 11 in a position which is very short in distance between the teeth 65 of the roll 63 and the outer periphery of the reel-spool 11 or the nip is positioned closely between the teeth 65 and the reel-spool 11. The principle of the separating mechanism 23" corresponds to the separating mechanism 23' described in FIG. 3*a*. The web loop 43 climbing upward in the vertical direction bounces against the rotating roll 63 and is drawn into the nip between the teeth and the reel-spool. The web 5 is thereby separated by the teeth 65 over its entire width. The loose end of the web, which is introduced into the nip between the teeth and the reel-spool, is further guided between the empty reel-spool 11 and the reeling drum 3 in the direction of the reel nip with the aid of the guiding plate 59, whereby a removal of the loose web end is hindered or retarded by the guiding plate 59 extending up to just before the reel nip.

Figure 5:
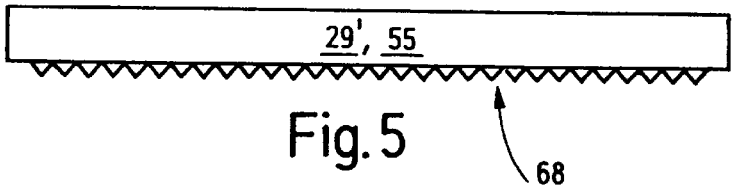
FIG. 5 illustrates a cross-section through an embodiment of a web separating element.

FIG. 5 shows a cross-section of an embodiment of the web separating element 29' described in FIGS. 3*a* and 3*b*, which is formed by a doctor 55, which extends at least essentially over the entire width of the web. The doctor 55 exhibits a serrated cutting edge 68. The serrations are distributed uniformly over the width of the doctor. With an uneven, that is, an irregular cutting edge, the web can be separated especially securely and a shred formation is retarded or hindered.

Figure 6A:
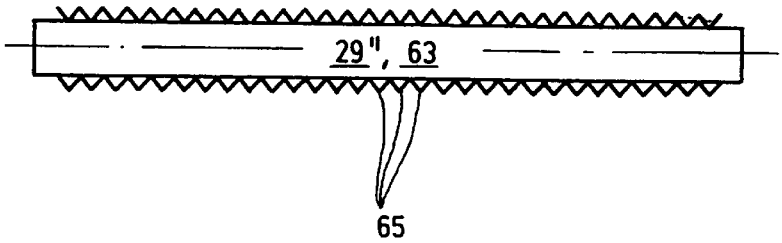
FIGS. 6*a* and 6*b* illustrate a cross-section and a side-view of another embodiment of the web separating element.
Figure 6B:
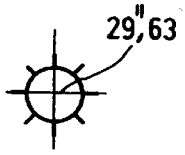

FIGS. 6*a* and 6*b* show schematically the roll 63, described in FIG. 4, and the teeth 65, which are uniformly distributed here over the length and the periphery and which are also referred to as spikes. The rotating direction of the drivable roll 63 is preferably adjustable in relation to the web velocity and/or to the characteristics of the web. The preferred rotational direction of the roll 63 is against the web run direction.

Figure 7:
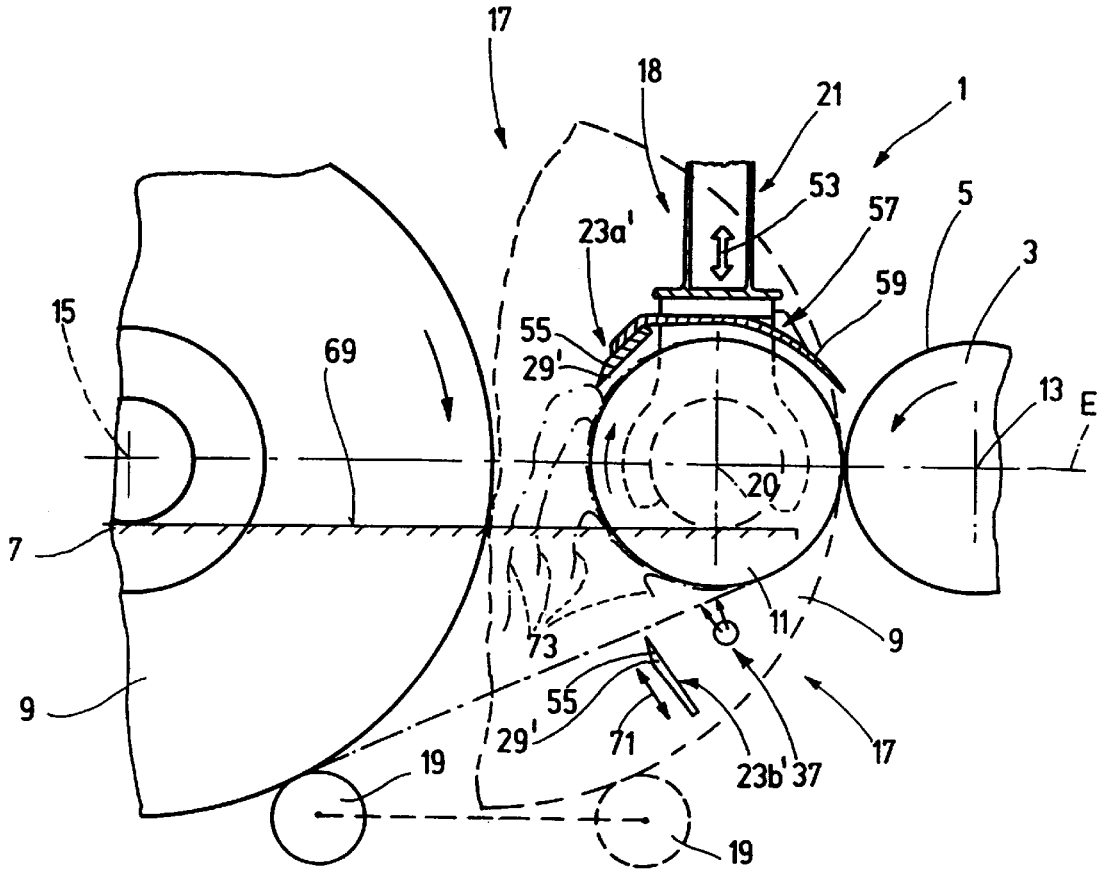
FIG. 7 illustrates a section of a fourth embodiment of the reeling machine, in side-view.

FIG. 7 shows a part of a fourth embodiment of the reeling machine 1 in side-view. Parts which correspond with those using the previous figures are given the same reference numbers, so to that extent, one can refer to the description of FIGS. 1 through 6. In the reeling machine 1 depicted in FIG. 7, two separating elements 23*a'* and 23*b'* are provided, which here comprise at least one web separating element 29' formed by a doctor 55. The first separating element 23*a'* is mounted on a beam 21—also characterized as a girder—, which can be displaced vertically (double arrow 53) above the reeling drum 3; the beam 21 is part of the transfer device 18 for the empty reel-spool 11. A guiding mechanism 57 subsequent to the separating element 23*a'* is also fastened to the beam 21, which comprises a curved guiding plate 59 extending transversely over the entire width of the web as well as in the run direction until just at the nip between the reel-spool 11 and the pop reel 3. The separating mechanism 23*a'* and the guiding plate 59 surround the upper area of the empty reel-spool 11. The cutting edge of the doctor 55 of the upper separating mechanism 23*a'* points against the rotational direction of the reel-spool 11.

The second separating mechanism 23*b'* is provided below the reel-spool 11, which is bolstered by rails 69, which are shown schematically, in the vicinity of the intermediary space 17 between the empty reel-spool 11 and the almost finished wound web roll 9. The doctor 55 of the lower separating mechanism 23*b'* can be displaced in the direction of the web 5, which is guided in a free stretch, as is highlighted by double arrow 71. Of course, the web separating element of the second separating mechanism 23*b'* also can be formed by a blowing or air jet, water jet device, or the like.

In the following, the operational method of both the separating devices 23*a'*, 23*b'* is explained in more detail. To prepare a reel-spool change, the intermediary space 17 is initially formed by displacing the complete wound web roll 9 along the rails 69 to the left. Then, the empty reel-spool 11 is advanced from above, together with the first separating mechanism 23*a'*, among others, and the guiding mechanism 57, through a—as noted by a double arrow 53—vertical displacement of the transfer device 18. The reel-spool 11 is deposited onto the rails 69 and a reel nip is formed between spool 11 and the reeling drum 3. While the web is still guided by the reeling drum 3 over a peripheral area of the reel-spool 11 to the wound web roll 9, the web 5 is separated by means of the second separating mechanism 23*b'*, which is arranged below the rails 69, in the vicinity of the free stretch. The loose end of the web 5 climbs—as shown by a dashed line—upward in a vertical direction. The climbing of the new web beginning is supported by the blow device 37. A flag (tail) 73 hanging downward is thereby formed, which becomes increasingly longer. So that the flag 73 does not reach the nip between the reel-spool 11 and the reel-drum 3 unchecked and therewith hindering a defined construction of the wound web roll, which is to be wound onto the reel-spool 11, the flag 73 is separated from the upper separating device 23*a'*. The web 5 is thus cut a second time transversely across the width by means of the fixed doctor 55 of the first separating mechanism 23*a'*. The second new web beginning, which is drawn into the nip between the doctor 55 of the separation device 23*a'* and the reel-spool 11, is guided into the reel nip between the reel-spool 11 and the reeling drum 3 evenly across the entire width; this process is due to a guidance mechanism 57 arranged subsequent—as seen in web run direction—to the separation device 23*a'*.

It must be emphasized that, in order to separate the web, the formation of a web loop by retarding the almost finished winding roll is not necessary with the reeling machine described using FIG. 7 through the use of both the separating mechanisms 23*a'*, 23*b'*.

Common to all embodiments of the reeling machine described using the FIGS. 1 through 7 is that the reel-spool lies on the preferably horizontally running rails 69 and is carried by these rails during a complete reeling process. It is especially advantageous if the reel-spool is moved along the beams exclusively by a transport device (not depicted in the figures), in order to balance out the enlarging diameter of the wound web roll, which is wound onto the reel-spool, and to adjust the line force in the reel nip between the reeling drum, which is stationary, and the wound web roll. Due to this embodiment, the reeling machine can be simplified and the winding effect improved. In all embodiments, at least one separating mechanism is provided, which separates the web—preferably—across the entire width. The separating mechanism is advanced from above to the separating area, in which the web is separated. It is possible to position the separating mechanism or its web separating element(s) at a short distance to the outer periphery of the empty reel-spool, such that the web can be separated in the immediate vicinity of the empty reel-spool 11. A shredding or shred formation is almost completely avoided, so that the beginning of new web can be wound onto the empty reel-spool with a definite or defined hardness without a problem.

Figure 8:
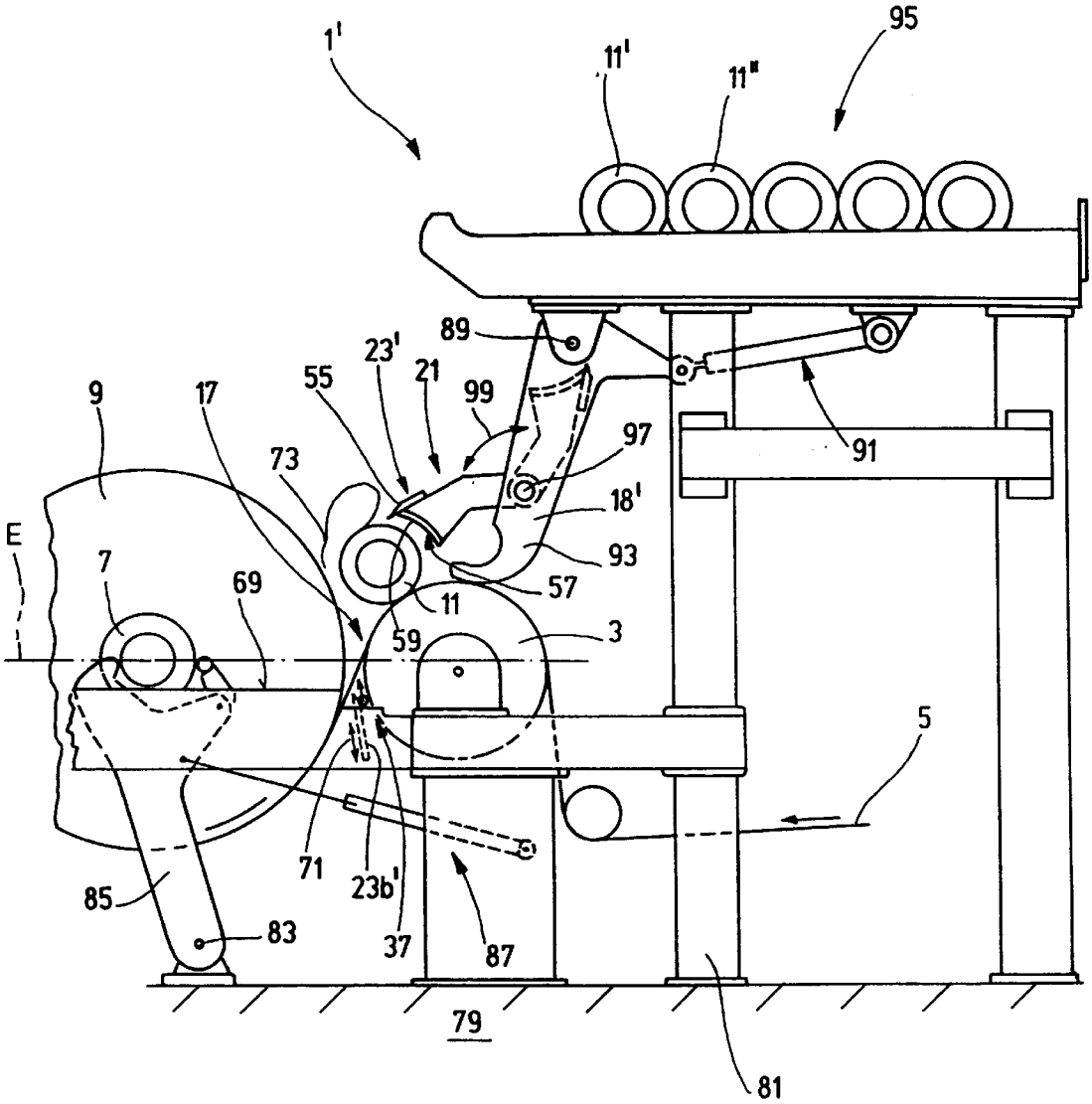
FIGS. 8 and 9 each show a section of a fifth embodiment of a reeling machine in various operational positions.
Figure 9:
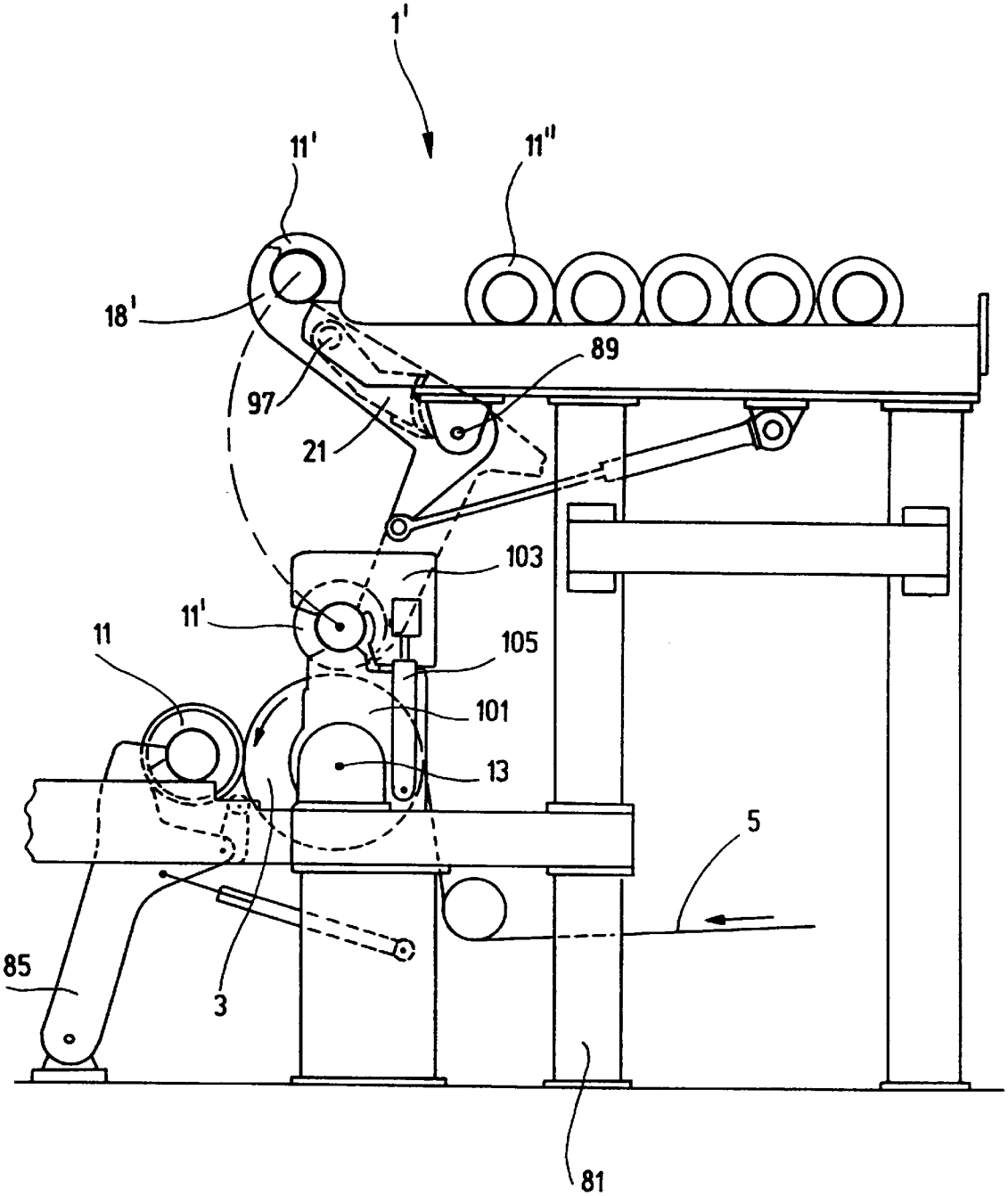

FIGS. 8 and 9 each show a part of a fifth embodiment of the reeling machine 1 in different operational positions. Parts which correspond with those of the previous FIGS. 1 through 7 are given the same reference numbers, so that the description can thus be referred to.

The reeling machine 1 comprises a machine frame 81 located on a foundation 79, to which the rails 69 are mounted. The rails 69 serve to carry a reel-spool with a wound web roll wound onto the web roll during the final winding process. During the process of winding on, the reel-spool is arranged above the rails and forms a winding nip with a reeling drum 3. After the web is transported onto the empty reel-spool, it is guided downwards over a peripheral area of the reeling drum 3, which is locally fixed and deposited onto the rails 69. The construction of the reeling machine 1', which is also referred to as a pope roller, is intrinsically known (U.S. Pat. No. 4,778,122), so that it is only briefly discussed below.

As can be seen from the illustration in accordance with FIG. 8, a reel-spool 7 carried by the rails 69 is guided with a wound web roll 9 wound thereon along the rails with the assistance of two secondary levers 85 (only one of which is depicted), which can be swivelled on an axis 83. The swivelling motion of the secondary levers 85 is caused by a lifting device 87, which is formed by a hydraulic piston/cylinder unit.

The reeling machine 1' comprises further—as can be seen from FIG. 9—two primary levers 101 which can be swivelled on an axis running vertical to the image plane of FIGS. 8 and 9, of which only one is depicted. An installation 103 keeping the reel-spool rotational is mounted to the primary levers 101; the installation 103 can be moved radially onto the primary levers 101 with the aid of a lifting device 105.

A transfer device 18' for an empty reel-spool 11, 11', 11", etc. is provided on a part of the machine frame 81 which is located above the reeling drum 3, which comprises at least two insertion levers, which can be swivelled on an axis 89 running perpendicular in the image plane of FIG. 8, with the aid of a lifting device 91 which is a piston/cylinder unit. In FIG. 8, only one insertion lever 93 is shown. The transfer direction serves to introduce an empty reel-spool downwardly from a reel-spool magazine 95 located above the reeling drum 3 into a transfer position, in which the empty reel-spool is put into the primary levers 101.

A beam 21, which extends transversely across the width of the web 5 and which is referred to as a girder, is arranged on the insertion levers 93; the beam 21 can be swivelled on an axis 97 running vertical to the image plane of FIGS. 8 and 9 in the direction of a double arrow 99 (FIG. 8). A separating mechanism 23' comprising a doctor 55 and a guiding mechanism 57 formed by a guiding plate 59 is fastened to the beam 21. The beam 21 can be swivelled by means of a mechanism (not depicted here) in a first operational position marked by a dashed line and in a second operational position marked with a solid line. In the first operational position, the beam 21, with the parts mounted thereon, is covered by the insertion levers 93 of the transfer device 18'. In this position of the beam 21, the separating mechanism 23' and the guiding device 57 are located in a neutral position, in which they do not disturb the reeling process.

The operation of the reeling machine 1' and the process using a reel-spool change is explained in more detail below. Initially, the wound web roll 9, which is carried by the rails 69, is moved to the left in FIG. 8, whereby a smaller intermediary space 17 is formed between wound web roll 9 and the reeling drum 3, in which the web is guided in a free stretch. Then, an empty reel-spool 11, which is guided by the primary levers 101, is pressed on the periphery of the reeling drum 3 by a radial displacement of the installation 103. Thereafter, the beam 21 is swivelled relative to the opposing insertion levers 93 arranged in their lower insertion position (FIG. 8), counter-clockwise into the second operational position. In this position, the doctor 55 of the separating mechanism 23' is arranged at a short distance to the outer periphery of the reel-spool 11; that is the nip between the cutting edge of the doctor 55 and the reel-spool is relatively narrow. Now, by braking the almost finished wound web roll 9, a web loop is formed, which climbs upward in a vertical direction in the intermediary space 17 between the wound web roll 9 and the reeling drum 3, which is supported by a blow device 37 arranged under the free web stretch. The web loop runs against the doctor 55 of the separating mechanism 23' and is separated therefrom. The loose end of the web 5 is defined in the self-closing nip between the empty reel-spool 11 and the reeling drum 3 with the aid of a guiding plate 59 and introduced uniformly over the width. Thereafter, the finished wound web roll 9 is extracted from the reeling machine 1' and the reel-spool 11 with the wound web roll wound thereon is deposited on the rails 69 and assumed by the secondary levers 85. The exchange of reel-spool is thus completed, so that the beam 21 can be swivelled back clockwise into the first operational position. Finally, the insertion levers 93 are swivelled clockwise upwardly into the position depicted in FIG. 9, in which an empty reel-spool 11' can be taken over from the reel-spool magazine 95. To prepare another reel-spool exchange, the insertion levers 93 are then again swivelled into the insertion position illustrated in FIG. 8, in which the empty reel-spool 11' can then be inserted into the installation mounted onto the primary levers 101.

In another embodiment of the reeling machine 1' depicted in FIGS. 8 and 9, another, second separating mechanism **23*b'* is provided (FIG. 8) below the reeling drum 3 in the vicinity of the intermediary space between the reeling drum 3 and the almost complete wound web roll 9; during an exchange of reel-spools, the device 23*b'*—using the manner described in FIG. 7—works in conjunction with the separating mechanism 23', which is mounted on the beam 21 and disposed above the reeling drum 3**.

Figure 10:
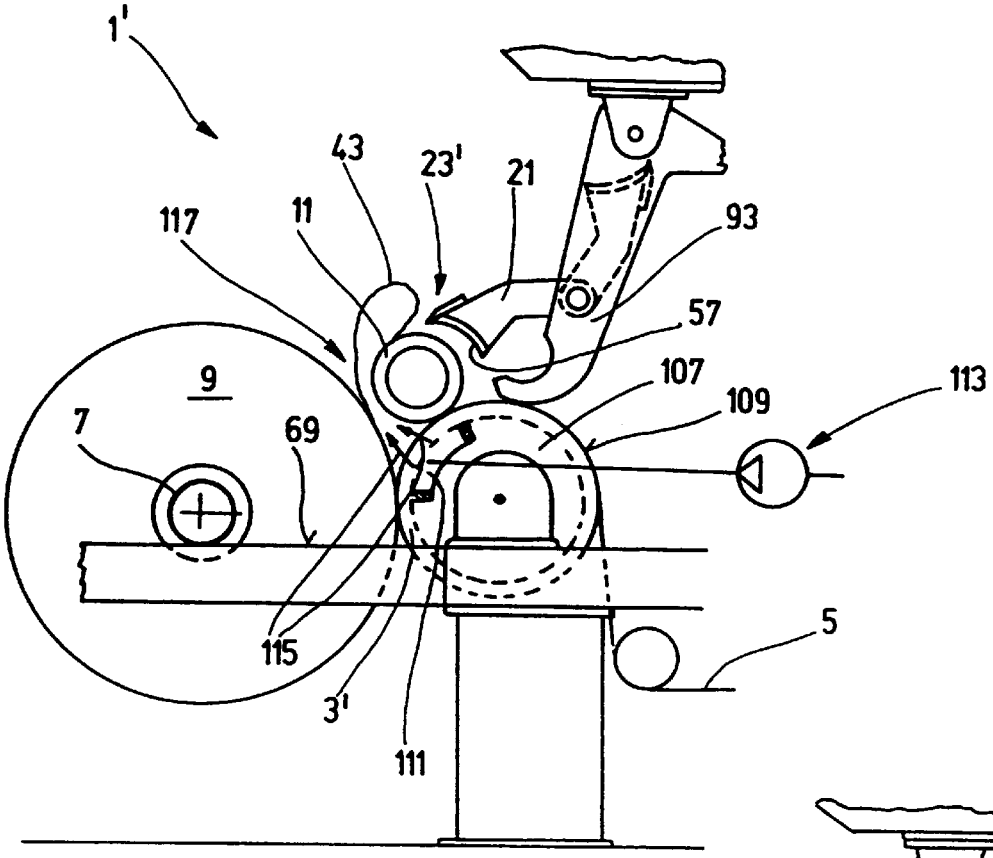
FIG. 10 illustrates a part of a sixth embodiment of the reeling machine.

FIG. 10 shows a sixth embodiment of the reeling machine in accordance with the invention, the construction of which essentially corresponds to the reeling machine 1' described in FIGS. 8 and 9. Identical parts are designated the same referential numbers, so that the previous figures can be referred to. The reeling machine 1' comprises a reeling drum 3', in the jacket of which is arranged, distributed ports (not depicted) are built-in, which connect in the interior space 107 of the reeling drum 3' to the outer periphery surfaces 109. In the interior space 107, a stationary blow box 111 is provided, which is connected to a pressure source 113, such as an air-pressure compressor. By means of the blow box 111, a medium flow, which is noted with arrows 115, can be blown in a vertical direction upward into an nip 117. The relatively narrow nip 117 is formed between the almost complete wound web roll 9 forming a reel nip with the reeling drum 3' and the empty reel-spool 11, which is likewise adjacent to the periphery of the reeling drum 3'. The reel-spool 11 is arranged in FIG. 10 in the position for winding on of a roll.

The special feature in the reeling machine 1' in accordance with FIG. 10 is that the contact, that is, the nip, exists between the almost complete wound web roll 9 and the reeling drum 3' from the beginning through to the end of the reeling process during a reel-spool change. To transfer the web 5 onto the reel-spool 11, the wound web roll 9 is retarded in its position illustrated in FIG. 10, whereby a web loop 43 climbing upward into the nip 117 forms; the loop 43 positions itself at the periphery of the reel-spool 11 and is separated in the separation area—which is provided at a short distance to the outer periphery of the reel-spool 11—by the separation mechanism 23' fastened to the beam 21. The formation of a web loop 43 is assisted by the medium flow emanating from the blow box 111; moreover, the flow guides the web loop in the direction of the nip 117.

Figure 11:
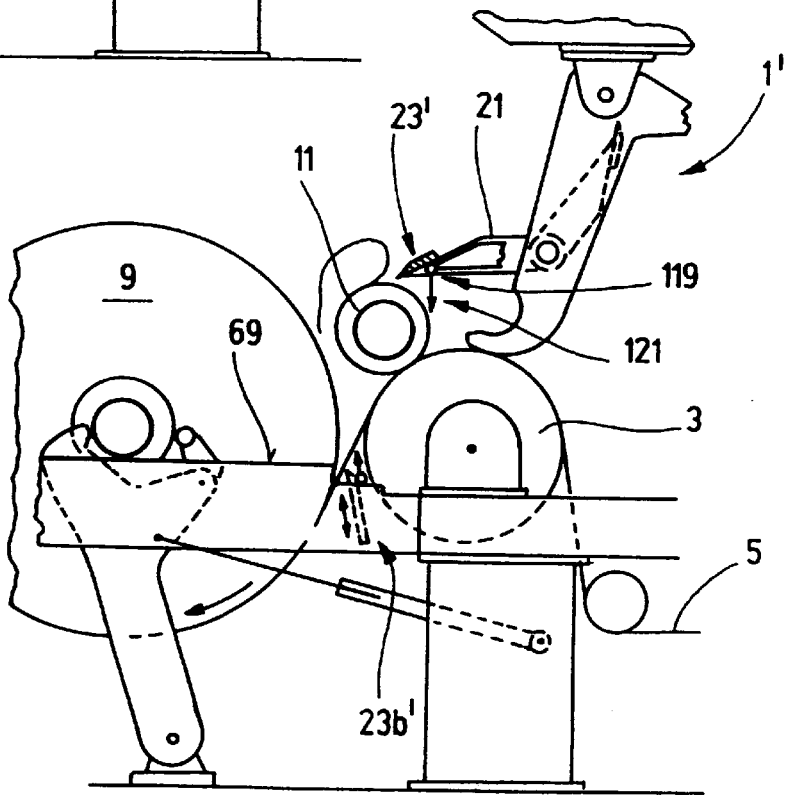
FIG. 11 illustrates a section of a seventh embodiment of the reeling machine, in side-view.

FIG. 11 shows another embodiment of the reeling machine in accordance with the invention in side-view, which characterizes itself from the reeling machine 1' described using FIGS. 8 and 9 only in that the guiding device 57 mounted to the beam 21 is formed by a blow device 119, which comprises at least one jet, preferably extending across the entire width of the web 5. With the assistance of a blow device 119, a medium flow, which is noted by an arrow 121 and which is aimed in the direction of the outer periphery of the reel-spool 11 and the nip between reel-spool 11 and the reeling drum 3, for example air or steam flow, can be introduced into the reeling machine 1'. The medium flow guides the loose end of the web 5 uniformly over the entire width in the nip between the empty reel-spool 11 and the reeling drum 3, whereby a defined construction of the wound web roll, which is to be wound onto the reel-spool 11, is possible.

Common to all embodiments of the reeling machine and the process which can therewith be realized, which are described using the FIGS. 1 through 11, is that a separation mechanism is advanced before a separation process from above into the separation area, in which the web is separated across its—preferably entire—width. Thus, in accordance with the invention, a short distance can thereby be adjusted between the separating device and the outer periphery of the empty reel-spool and/or—as seen in a web run direction—of the nip between the empty reel-spool and the reeling drum. Due to the short distance between the cutting edge and the separation edge of the separating mechanism, the remaining flag, which does not position itself on the outer periphery of the empty reel-spool after a separation procedure, is only very short, whereby the beginning of new web can be guided uniformly over the width in the nip between the empty reel-spool and the reeling drum. In particular, a shredding formation, that is, a formation of shreds of the web can be almost completely avoided because of the short flag, and is at the very least reduced in comparison to the known reeling machine. Thus an uncomplicated winding-on of the new reel-spool is possible, whereby the reeling quality is improved.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. Reeling machine for taking up a web, in particular a paper or cardboard web, for the formation of a wound web roll on a reel-spool, a reeling drum which forms a reeling nip with the wound web roll, at least one device which forms a free web loop between a new reel-spool and the wound web roll, and at least one separating mechanism for separating the web in a separation area, wherein the separation mechanism is movable from a first position spaced vertically above the separating area to a second position within the separation area, wherein when said separating mechanism is in said second position, the new reel-spool is pressed against the outer surface of the reeling drum with a predetermined force to form a reeling nip therewith, and wherein said separation area lies at one of a short distance from the outer periphery of the new reel-spool and at the reeling nip between the reeling drum and the new reel-spool and at a position along the free web loop.

2. A feeling machine for taking up a paper or cardboard web so as to form a wound web roll on a reel-spool, comprising:

a reeling drum positioned so as to form a nip with the wound web roll;

at least one device which forms a free web loop between a new reel-spool and the wound web roll; and at least one separating mechanism separating the web in a separation area;

wherein the separating mechanism is movable to at least two positions, one position of the separating mechanism being spaced vertically above the separating area prior to a separating procedure, another position of the separating mechanism being within the separation area when the new reel-spool is pressed against the outer surface of the reeling drum with a predetermined force to form a reeling nip therewith, the separating area being spaced from an outer periphery of the new reel-spool by a predetermined distance and at a location along the free web loop formed between the new reel-spool and the wound web roll.

3. Reeling machine in accordance with claim 2, wherein said free web loop is formed, in a region where the separating mechanism separates the web.

4. Reeling machine in accordance with claim 2, wherein at least one of a blow device and a blowpipe is provided to guide a loose end of the web onto an empty reel-spool and at least one jet is provided to blow one of a fluid and gaseous medium on a surface of the empty reel-spool.

5. Reeling machine in accordance with claim 2, wherein a guiding device is positioned subsequent to the separating mechanism, in the run direction, so as to guide an end of the web.

6. Reeling machine in accordance with claim 5, wherein the guiding device is comprised of at least one of a guiding plate, that extends across an entire width of the web, a textile curtain, a synthetic sheeting and a blowing device.

7. Reeling machine in accordance with claim 6, wherein the guiding plate is provided with a curved progression.

8. Reeling machine in accordance with claim 2, wherein the separating mechanism comprises at least one web separating element comprised of one of a water jetting device, a doctor, a needle, a laser device and a toothed roll on an outer periphery.

9. Reeling machine in accordance with claim 2, wherein the separating mechanism comprises at least one web separating element, the web separating element, in a separating position, is inclined against the run direction of the web at an angle $\alpha$, which lies in a vicinity of 0° and 120°.

10. Reeling machine in accordance with claim 2, wherein at least one of the separating mechanism and a web separating element of the separating mechanism is displaceable in the direction of the web.

11. Reeling machine in accordance with claim 2, wherein the separating mechanism comprises at least one web separating element and the web separating element is at least one of rotatable on a first axis and swivellable on a second axis.

12. Reeling machine in accordance with claim 2, wherein the separating mechanism comprises at least one web separating element and the web separating element is controlled by a control device.

13. Reeling machine in accordance with claim 2, wherein the separating mechanism is movable along a beam extending at least essentially transversely across a width of the web.

14. Reeling machine in accordance with claim 2, wherein the separating mechanism comprises at least two web separating elements, which are movable essentially in opposite motions.

15. Reeling machine in accordance with claim 2, wherein at least one of the separating mechanism, a guiding device, and a jet for guiding the web over a new reel-spool are arranged on a transfer device for said new reel-spool, the transfer device assisting the empty reel-spool to be displaced from a holding position downward in a take-up direction.

16. Reeling machine in accordance with claim 2, further comprising a second separating mechanism comprising at least one web separating element, the second separating mechanism being positioned ahead of said at least one separating mechanism is the run direction.

17. Reeling machine in accordance with claim 16, wherein the second separating mechanism separates the web in the separation process and thereafter the first separating mechanism separates a strip, which extends transversely across the width of the web, from a loose end of the web to be wound onto a new reel-spool.

18. Reeling machine in accordance with claim 2, further comprising an auxiliary roll that is pressable against a periphery the wound web roll.

19. A reeling machine in accordance with claim 18, wherein the auxiliary is movable.

20. Reeling machine in accordance with claim 9, wherein the web separating element is a doctor.

21. Reeling machine in accordance with claim 6, wherein the guiding plate extends an entire width of the web.

22. Process for reeling a web, especially paper or cardboard web, from a reel-spool onto a wound web roll, comprising:

inserting an empty reel-spool from above into a separating area and pressing the new reel-spool against the outer surface of a reeling drum with a predetermined force to form a reeling nip therewith, the web being guided over the periphery of the reel-spool in some areas;

forming at least one free web loop between the new reel-spool and the wound web roll;

separating the web at a location along the free web loop, which is adjacent to the outer periphery of the new reel-spool in some areas, at one of (1) a short distance from the new reel-spool and (2) from the wound web roll between the reeling drum and the new reel-spool in the run direction of the web; and winding the loose end of the web onto the empty reel-spool.

23. Process in accordance with claim 22, wherein upon changing the reel-spool, the web is separated at two places transversely across the width.

24. Process in accordance with claim 22, further comprising, forming an intermediary space in preparation of a reel-spool change between the reeling drum and an almost finished wound web roll, in which the web is guided in a free stretch.

25. A process for reeling a paper or cardboard web from a reel-spool onto a wound web roll, comprising:

inserting an empty reel-spool from above and in a vertical direction into a separating area and pressing the reel-spool against the outer surface of the reeling drum with a predetermined force to form a reeling nip therewith and guiding the web over a periphery of the reel-spool;

forming at least one free web loop between the new reel-spool and the wound web roll;

separating the web at a location along the free web loop that is at least one of adjacent to the periphery of the reel-spool, near the reel-spool, and between the wound web roll and the reel-spool; and winding a loose end of the web on the reel-spool.

26. The process of claim 25, wherein the web is separated subsequently to the reel-spool change.

* * * * *